United States Patent [19]

Yanagida

[11] Patent Number: 4,490,699

[45] Date of Patent: Dec. 25, 1984

[54] INTERMEDIATE FREQUENCY BAND-PASS FILTER

[75] Inventor: Hiroyuki Yanagida, Soma, Japan

[73] Assignee: Alps Electric Co., Ltd., Tokyo, Japan

[21] Appl. No.: 498,455

[22] Filed: May 26, 1983

[30] Foreign Application Priority Data

May 27, 1982 [JP] Japan ..... 57-76893[U]

[51] Int. Cl.[3] ..... H01P 1/20; H01P 7/01; H01P 7/09

[52] U.S. Cl. ..... 333/202; 333/176; 333/177; 333/212

[58] Field of Search ..... 333/174–180, 333/202, 185, 206–212, 245, 248; 334/41–45, 85

[56] References Cited

U.S. PATENT DOCUMENTS

| | | | |
|---|---|---|---|
| 2,819,391 | 1/1958 | Reiches | 334/43 X |
| 3,337,791 | 8/1967 | Barton et al. | 334/41 X |
| 3,621,484 | 11/1971 | Shult | 333/202 |

*Primary Examiner*—Marvin L. Nussbaum

*Attorney, Agent, or Firm*—Guy W. Shoup; Gerard F. Dunne

[57] ABSTRACT

An intermediate frequency band-pass filter for providing a pass band, comprising a frame forming a hollow surrounded region, a shield plate mounted in the frame and dividing the hollow surrounded region into two spaces, the shield plate having a coupling window, and two resonators disposed respectively in the spaces and coupled through the coupling window, the shield plate having in an edge thereof a step serving as a trap which provides a frequency suppression capability in the vicinity of the pass band of the filter.

3 Claims, 6 Drawing Figures

INTERMEDIATE FREQUENCY BAND-PASS FILTER

BACKGROUND OF THE INVENTION

The present invention relates to an intermediate frequency band-pass filter suitable for use in a converter in a community antenna or wire television receiver.

Community antenna or wire television broadcasting systems (hereinafter referred to as a "CATV system") are widely used to eliminate areas in which radio television broadcasting cannot be received and to provide communities with various kinds of information. In the CATV system, television programs are transmitted from a broadcasting station through cables, and television receivers in subscriber's homes select a desired channel out of the received channels. Since the CATV system can have a wide frequency band irrespective of other broadcasting systems, the CATV system is assigned a large number of channels. The television receiver has a frequency converter of the superheterodyne type for selecting a desired channel out of a number of channels and converting the frequency of the selected channel into a predetermined intermediate frequency.

SUMMARY OF THE INVENTION

It is an object of the present invention to provide an inexpensive intermediate frequency band-pass filter which forms a trap having sufficient frequency suppression capability without including an additional trap circuit, and needs no trap frequency adjustment.

According to the present invention the above object can be achieved by providing a shield plate disposed between resonators constituting a double tuning circuit and having a coupling window, the shield plate having in an edge thereof a step which serves as a trap.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 1:
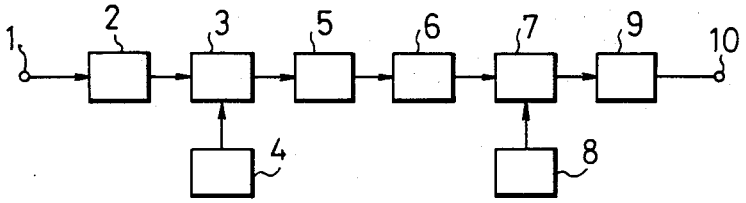
FIG. 1 is a block diagram of a converter in a conventional wire television receiver.

FIG. 1 shows in block form a conventional frequency converter, which comprises an input terminal 1, an input filter 2, a mixer 3, a local oscillator 4, an intermediate frequency filter 5, an intermediate frequency amplifier 6, a mixer 7, a local oscillator 8, an output filter 9, and an output terminal 10.

A number of channels transmitted over a cable (not shown) are supplied through the input terminal 1 and the input filter 2 to the mixer 3, in which the frequencies are mixed with a signal having a frequency $f_{L1}$ (hereinafter referred to as a "first oscillation frequency signal") supplied from the local oscillator 4.

The oscillation frequency $f_{L1}$ from the local oscillator 4 is variable so that a desired channel to be selected out of the channels transmitted through the input terminal 1 will be in a predetermined frequency band. The mixer 3 produces as its output each channel with its frequency converted to allow the desired channel to have the predetermined frequency band. The output from the mixer 3 is supplied to the intermediate frequency band-pass filter 5.

The intermediate frequency band-pass filter 5 is designed to pass therethough the foregoing predetermined frequency band. Therefore, it only passes the desired channel selected out of the supplied channels. The signal in the desired channel is amplified by the intermediate frequency amplifier 6, and the amplified signal is fed to the mixer 7, in which it is mixed with a signal having a frequency $f_{L2}$ (hereinafter referred to as a "second oscillation frequency signal") delivered from the local oscillator 8.

The oscillation frequency $f_{L2}$ generated by the local oscillator 8 is fixed. The frequency of the desired channel is converted by the mixer 7 into a certain frequency which is fed through the output filter 9 to the output terminal 10.

The input filter 2 and the intermediate frequency band-pass filter 5 have pass bands designed such that they are sufficiently different from the range which the oscillation frequency $f_{L1}$ from the local oscillator 4 can take, and are capable of sufficiently suppressing the first oscillation frequency signal which leaks from the mixer 3. In order to produce a channel signal of the predetermined intermediate frequency at the output terminal 10, however, it is necessary that the oscillation frequency $f_{L2}$ of the local oscillator 8 be selected in the vicinity of the pass band of the intermediate frequency band-pass filter 5. Since the second oscillation frequency signal which has leaked from the mixer 7 is supplied through the intermediate frequency amplifier 6 to the intermediate frequency band-pass filter 5, and the blocking characteristics of the the intermediate frequency band-pass filter 5 cannot be sharper than a certain degree, the second oscillation frequency signal is not sufficiently suppressed by the intermediate frequency band-pass filter 5 and is fed to the mixer 3. The second oscillation frequency signal is then mixed with the first oscillation frequency signal, producing a beat signal having a frequency $f_{L1}-f_{L2}$. Since the frequency of the beat signal falls sometimes within the pass band of the input filter 2, the beat signal tends to pass through the input filter 2 and the input terminal 1 into the cable, not shown.

As an example, a CATV system having a full-channel frequency range of 55 MHz to 445 MHz is characterized by:

Pass band of the input filter: 55 MHz–445 MHz,

Oscillation frequency $f_{L1}$ of the local oscillator 4: 605 MHz–995 MHz,

Resonant frequency of the intermediate frequency band-pass filter 5: 550 MHz, Oscillation frequency $f_{L2}$ of the local oscillator 8: 605 MHz, and Channel frequency of the output terminal 10: 55 MHz. The frequency $f_{L2}$ of the second oscillation frequency signal and the resonant frequency of the intermediate frequency band-pass filter 5 are different from each other only by 605 MHz−550 MHz=55 MHz. The leaking second oscillation frequency signal is accordingly liable to be supplied to the mixer 3 without being sufficiently suppressed by the intermediate frequency band-pass filter 5. The mixer 3 then produces a beat signal having the frequency of (605 MHz or 995 MHz)−605 MHz=0 or 390 MHz. Those components in the beat signal which fall within the pass band of the input filter 2 are allowed to pass through the latter.

When such a beat signal is generated and discharged, it will be transmitted through the cable and received by other television receivers. If the other television receivers select a channel containing the beat signal, the selected channel is disturbed by the beat signal.

To remove the unwanted beat signal, there has conventionally provided a trap circuit in the intermediate frequency band-pass filter 5.

Figure 2:
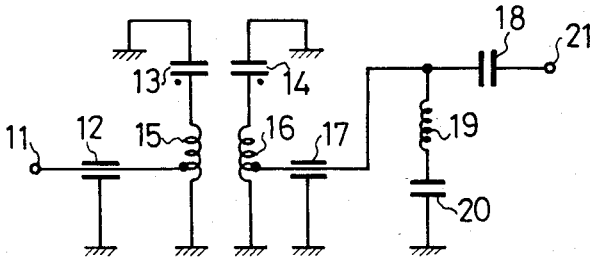
FIG. 2 is a circuit diagram of an intermediate frequency band-pass filter in the converter of FIG. 1.

FIG. 2 is a circuit diagram showing such a prior intermediate frequency band-pass filter, which is composed of an input terminal 11, a capacitor 12, tuning capacitors 13, 14, tuning coils 15, 16, a trap coil 19, a trap capacitor 20, and an output terminal 21.

The tuning circuit of the tuning capacitor 13 and the tuning coil 15, and the tuning circuit of the tuning capacitor 14 and the tuning coil 16 jointly form a double tuning circuit for providing a prescribed pass band. A desired channel which falls in the prescribed pass band is selected out of a number of channels which are represented by an output signal from the mixer 3 (FIG. 1) through the input terminal 11, and is supplied through the output terminal 21 to the intermediate frequency amplifier 6 (FIG. 1).

The intermediate frequency band-pass filter includes a trap circuit composed of the trap coil 19 and the trap capacitor 20. The trap frequency is selected to be the oscillation frequency $f_{L2}$ of the local oscillator 8 for preventing the second oscillation frequency signal from going from the output terminal 21 to the input terminal 11.

The resonators which form the tuning circuits (FIG. 2) are surrounded by a frame and placed respectively in two regions separated by a shield plate, the shield plate having a coupling window through which the tuning coils 15, 16 (FIG. 2) of the resonators are coupled.

According to the prior art, it has been necessary to provide the trap circuit in the intermediate frequency band-pass filter. As a result, the intermediate frequency band-pass filter has had the following shortcomings: The intermediate frequency band-pass filter is costly to fabricate as additional electronic parts are required to assemble the trap circuit and a process is needed to attach the trap circuit. Since constants of the electronic parts vary, the trap frequency has to be adjusted. An expensive temperature-compensation capacitor is necessary for the temperature compensation of the trap circuit. Since the trap circuit is inserted in the intermediate frequency band-pass filter where the impedance is low, the trap circuit cannot have a high Q, failing to supress the second oscillation frequency signal to a sufficient degree.

The present invention will now be described with reference to FIGS. 3 through 6.

Figure 3:
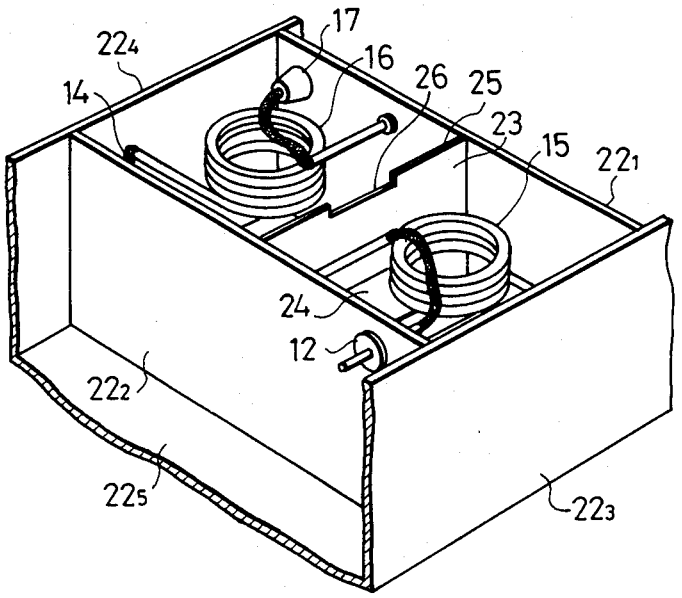
FIG. 3 is an enlarged perspective view of an intermediate frequency band-pass filter according to the present invention.

FIG. 3 shows an intermediate frequency band-pass filter according to the present invention. Like or corresponding parts in FIG. 3 are denoted by like or corresponding reference numerals in FIG. 2. The filter comprises a frame composed of frame members $22_1$, $22_2$, $22_3$, $22_4$, $22_5$, a shield plate 23 having a coupling window 24 and an upper edge 25 cut out to provide a step or rectangular recess 26. The frame members $22_1$, $22_2$, $22_3$, $22_4$ serve as side walls, the frame member $22_5$ as a bottom, and a frame member (not shown) is used as a cover. These frame members jointly form a hollow region. The shield plate 23 extends between the side walls $22_1$, $22_2$ to devide the hollow region into two spaces in which the resonators are mounted respectively.

The coupling window 24 in the shield plate 23 serves to couple helical coils 15, 16 which are tuning coils, the degree of coupling being determined by the shape of the coupling window.

The step 26 formed in the upper edge 25 of the shield plate 23 serves as a window when the cover is placed over and closes the hollow region. The window provides communication between the two spaces separated by the shield plate 23. The step 26 in the shield plate 23 can provide a trap in the intermediate frequency band-pass filter. The trap frequency is determined by the width of the step 23 in the direction normal to the side wall $22_1$ or $22_2$. The width of the step 23 is selected such that the trap frequency is equal to the oscillation frequency $f_{L2}$ of the local oscillator 8 (FIG. 1).

Figure 4:
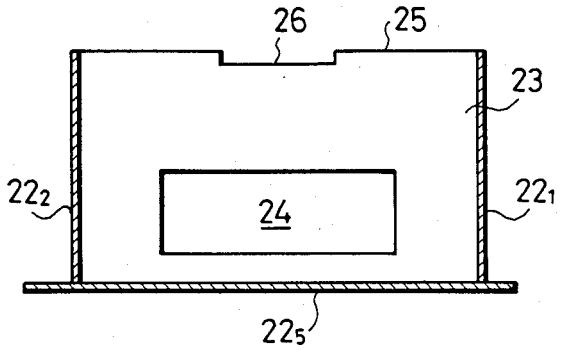
FIG. 4 is a front elevational view of a shield plate in the filter shown in FIG. 3.

FIG. 4 is a front elevational view of the shield plate of FIG. 3. Like or corresponding parts in FIG. 4 are indicated by like or corresponding reference numerals in FIG. 3 and will not be described.

Figure 5:
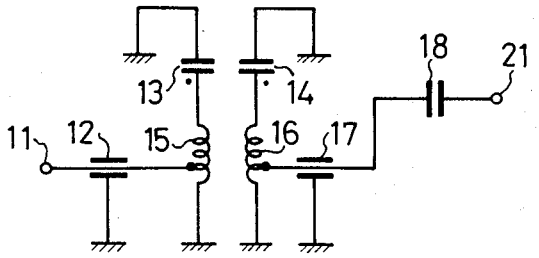
FIG. 5 is a circuit diagram of an equivalent circuit of the filter of FIG. 3.

FIG. 5 shows an equivalent circuit of the intermediate frequency band-pass filter illustrated in FIG. 3. Like or corresponding parts in FIG. 5 are denoted by like or corresponding reference numerals in FIG. 2. With this arrangement, the double tuning circuit has a trap or frequency signal suppression capability, and there is no need for an additional trap circuit.

Figure 6:
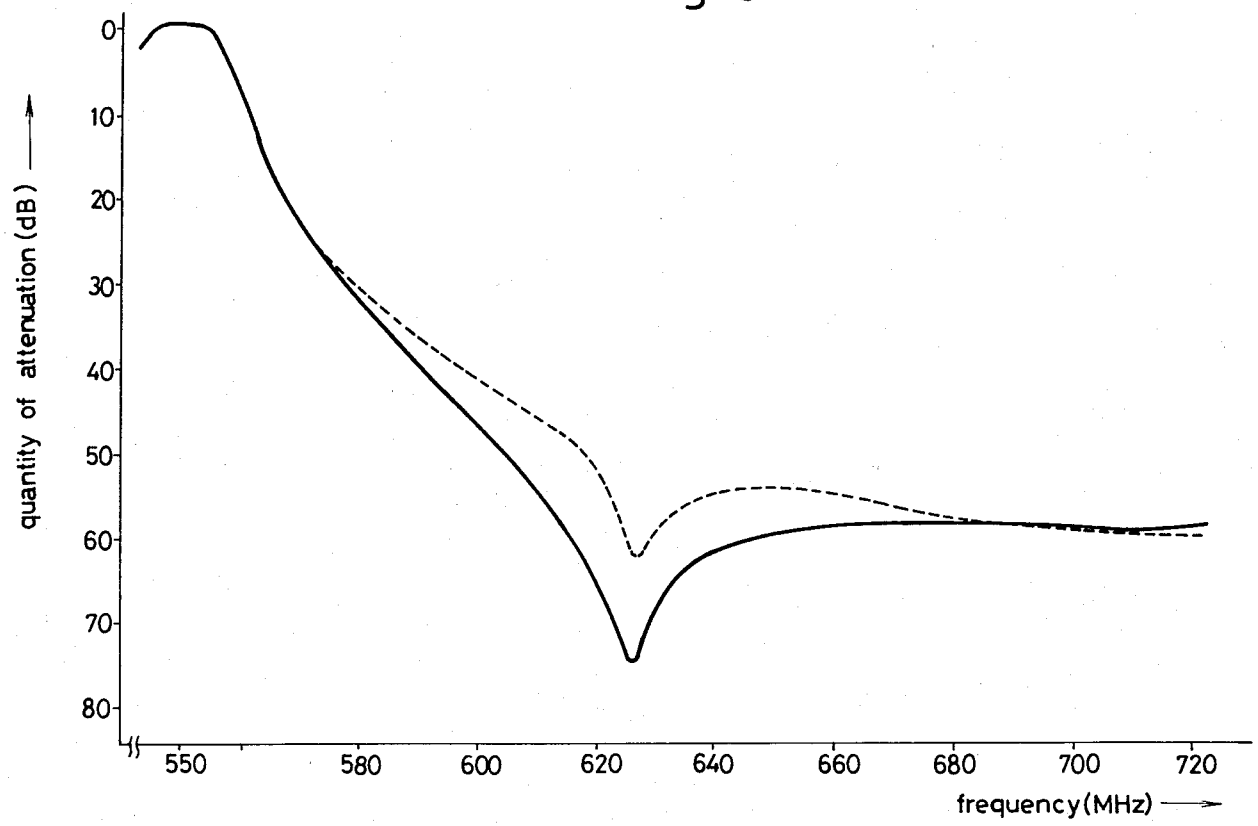
FIG. 6 is a graph showing the measured high-frequency characteristics of the intermediate frequency band-pass filter of FIG. 3 and a prior intermediate frequency band-pass filter.

FIG. 6 shows measured high-frequency characteristics of intermediate frequency band-pass filters. The graph has a vertical axis indicative of the amount of suppression, and a horizontal axis indicative of the frequency. The solid-line curve represents the characteristics of the intermediate frequency band-pass filter of the present invention, while the dotted-line curve represents the characteristics of the prior intermediate frequency band-pass filter. The characteristic curves in FIG. 6 were plotted when the oscillation frequency $f_{L2}$ of the local oscillator 8 (FIG. 1) was 620 MHz. Study of FIG. 6 clearly shows that the frequency was suppressed by the filter of the invention sufficiently to the extent that is about 15 dB higher than by the conventional filter.

The present invention is also applicable to other uses than intermediate frequency band-pass filters in CATV converters. The numerical data referred to in the above description are by way of example only, and should not be interpreted as being limitative.

With the arrangement of the present invention, a desired trap can be formed by cutting out a step in an edge of a shield plate having a coupling window through which resonators are coupled with each other. There is no need for an additional trap circuit which has been necessitated in the prior art. Since the trap frequency is determined solely by the configuration of the step, no trap frequency adjustment is required. Accordingly, the intermediate frequency band-pass filter of the invention is less costly to fabricate, and can provide a desired frequency suppression capability.

Although a certain preferred embodiment has been shown and described, it should be understood that many changes and modifications may be made therein without departing from the scope of the appended claims.

What is claimed is:

1. An intermediate frequency band-pass filter for providing a pass band, comprising a frame forming a hollow surrounded region, a shield plate mounted in said frame and dividing said hollow surrounded region into two spaces, said shield plate having a coupling window, and two resonators disposed respectively in said spaces and coupled through said coupling window, said shield plate having in an edge thereof a step serving as a trap which provides a frequency suppresion capability in the vicinity of the pass band of the filter.

2. An intermediate frequency band-pass filter according to claim 1, wherein said edge of said shield plate is an upper edge thereof.

3. An intermediate frequency band-pass filter according to claim 1, wherein said step is in the form of a rectangular recess cut out of said edge of said shield plate.

* * * * *